United States Patent [19]

Takahashi et al.

[11] Patent Number: 4,918,944

[45] Date of Patent: Apr. 24, 1990

[54] FALLING FILM EVAPORATOR

[75] Inventors: Kenji Takahashi, Abiko; Takuji Torii, Ushiku; Takao Senshu, Shizuoka; Tetsuji Yamashita, Shizuoka; Shizuo Zushi, Hadano all of Japan

[73] Assignee: Hitachi, Ltd., Tokyo, Japan

[21] Appl. No.: 260,698

[22] Filed: Oct. 21, 1988

[30] Foreign Application Priority Data

Oct. 23, 1987 [JP] Japan ..... 62-266389

[51] Int. Cl.[5] ..... F75B 43/02

[52] U.S. Cl. ..... 62/471; 62/525; 165/117

[58] Field of Search ..... 62/471, 525, 503, 512; 165/115, 117, 118

[56] References Cited

U.S. PATENT DOCUMENTS

| | | | |
|---|---|---|---|
| 1,694,370 | 12/1928 | Burdick | 165/118 X |
| 1,719,808 | 7/1929 | Kucher | 62/503 |
| 2,328,511 | 8/1943 | Thomas | 62/471 |
| 2,519,845 | 8/1950 | Mojonnier et al. | 62/141 |
| 3,232,073 | 2/1966 | Jobes et al. | 62/512 X |
| 3,271,969 | 9/1966 | Lorentzen | 62/525 X |
| 3,438,218 | 4/1969 | O'Neil | 62/218 |
| 3,621,673 | 11/1971 | Foust | 62/503 |
| 3,978,685 | 9/1976 | Taylor | 62/471 |
| 4,187,695 | 2/1980 | Schumacker | 62/471 X |
| 4,217,765 | 8/1980 | Ecker | 63/503 |
| 4,520,866 | 6/1985 | Nakajima et al. | 165/115 |
| 4,572,287 | 2/1986 | Allo et al. | 165/118 |
| 4,641,706 | 2/1987 | Haynie | 165/118 |
| 4,679,410 | 7/1987 | Drayer | 62/503 |

FOREIGN PATENT DOCUMENTS

| | | |
|---|---|---|
| 0104750 | 4/1984 | European Pat. Off. . |
| 0313079 | 10/1989 | European Pat. Off. . |
| 3223056 | 12/1983 | Fed. Rep. of Germany . |

*Primary Examiner*—William E. Tapolcai

*Attorney, Agent, or Firm*—Antonelli, Terry & Wands

[57] ABSTRACT

This invention relates to a falling film evaporator which is arranged to cause a liquid film to flow downward to thereby effect heat exchange using evaporation. In a space of an evaporating compartment, a gas-liquid separator is disposed to communicate with a compressor which constitutes a part of a refrigeration cycle.

13 Claims, 9 Drawing Sheets

FALLING FILM EVAPORATOR

BACKGROUND OF THE INVENTION

1. Field of the Invention

The present invention relates to a falling film evaporator which is arranged to effect heat exchange by utilizing the evaporation of a liquid film during downward flow thereof and, more particularly, to a falling film evaporator of the type suitable for use in various kinds of system for effecting cooling of equipment, an apparatus for supplying cooling water for air-conditioning and an electric power plant using ocean thermal energy.

2. Description of the Related Art

A conventional type of falling film evaporator described in, for example, Japanese Patent Unexamined Publication No. 59-212601 and U.S. Pat. No. 4,520,866. This kind of evaporator has the following structure. Liquid refrigerant flows into an evaporator shell through a liquid refrigerant inlet formed in an upper portion of the evaporator shell, and flows down in the form of a thin film over the outer surfaces of a multiplicity of heat exchanger tubes provided within the evaporator shell. The liquid refrigerant evaporates by absorbing the heat of the cooling water flowing in the heat exchanger tubes, and thus cools the cooling water. The resultant gasified refrigerant flows out through a refrigerant gas outlet. The cooling water thus cooled flows out of the evaporator through a cooling water outlet, then enters the line of an object to be cooled, and is subsequently returned to the cooling water inlet of the evaporator by the circulating motion of a circulating pump.

In a refrigeration cycle which incorporates the above-described conventional falling film evaporator, the refrigerant which has been nearly gasified by the evaporator is supplied to a compressor, but if an excessive amount of liquid refrigerant is supplied to the compressor, it may be damaged. For this reason, a gas-liquid separator is provided between the evaporator and the compressor in order to reserve the extra portion of the liquid refrigerant which has been left in a liquid state because of its imperfect evaporation in the evaporator which often takes place during system start-up or due to a decrease in the temperature of a heat load. In addition, the gas-liquid separator is adapted to recover a portion of the compressor-lubricating oil stored in a bottom portion of the evaporator, through a pipeline which is disposed separately from a refrigerant gas outlet pipeline. However, the gas-liquid separator which is disposed between the evaporator and the compressor in the above-described manner has the problems of increasing the overall size of the apparatus and of producing pressure loss and heat loss to deteriorate the efficiency of the refrigeration cycle.

SUMMARY OF THE INVENTION

It is, therefore, an object of the present invention to provide a falling film evaporator which is simple in structure and yet which is capable of enhancing the efficiency of a refrigeration cycle.

It is another object of the present invention to decrease the area required to install equipment by incorporating a gas-liquid separator into an evaporator, which has otherwise been arranged in the exterior of the evaporator.

To achieve the above and other objects, in accordance with a first feature of the present invention, there is provided an improvement in a falling film evaporator in which a plurality of heat exchanger tubes are provided in a shell to form an evaporating compartment utilizing a falling film, the liquid-film flow of a liquid refrigerant being formed over the outside surfaces of the heat exchanger tubes to effect heat exchange between the liquid refrigerant and the fluid flowing in the heat exchanger tubes. The improvement is characterized by gas-liquid separating means which is arranged in the space of the evaporating compartment so as to communicate with a compressor which constitutes a part of a refrigeration cycle.

In accordance with a second feature of the present invention, there is provided an improvement in a falling film evaporator in which a plurality of heat exchanger tubes are provided in a shell to form an evaporating compartment utilizing a falling film, the liquid-film flow of a liquid refrigerant being formed over the outside surfaces of the heat exchanger tubes to effect heat exchange between the liquid refrigerant and the fluid flowing in the heat exchanger tubes. The improvement is characterized by a pipeline, through which the refrigerant in the evaporating compartment is supplied to a compressor which constitutes a part of a refrigeration cycle, being arranged in the evaporating compartment, the pipeline having a lubricating-oil supplying portion through which the lubricating oil in the evaporating compartment is supplied to the pipeline.

In accordance with a third embodiment of the present invention, there is provided an improvement in a falling film evaporator in which a plurality of heat exchanger tubes are provided in a shell to form an evaporating compartment utilizing a falling film, the liquid-film flow of a liquid refrigerant being formed over the outside surfaces of the heat exchanger tubes to effect heat exchange between the liquid refrigerant and the fluid flowing in the heat exchanger tubes. The improvement is characterized by a first pipeline which connects the liquid refrigerant inlet of the shell with the compressor side of a refrigeration cycle, a second pipeline which connects the refrigerant outlet of the evaporating compartment with the compressor which constitutes a part of the refrigeration cycle, and lubricating-oil supply means disposed in the pipeline through which the lubricating oil in the evaporating compartment is supplied to the second pipeline.

In accordance with a fourth feature of the present invention, there is provided a falling film evaporator which includes an evaporator shell, an upper fluid compartment which is arranged at an upper portion of the evaporator shell, a lower fluid compartment which is arranged at a lower portion of the evaporator shell, a refrigerant distributing compartment which is arranged below the upper fluid compartment, an evaporating compartment arranged between the refrigerant distributing compartment and the lower fluid compartment, a multiplicity of heat exchanger tubes, each of which extends through the refrigerant distributing compartment and the evaporating compartment, each of the exchanger tubes having one end whose opening is located in the upper fluid compartment and the other end whose opening is located in the lower fluid compartment, means for supplying cooling water to the upper fluid compartment, means for discharging the cooling water from the lower fluid compartment, means for supplying a refrigerant containing a lubricating oil to the refrigerant distributing compartment, means for causing the liquid refrigerant in the refrigerant distributing compartment to flow downward over the outside surfaces of the respective heat exchanger tubes, and refrigerant discharging means for discharging the gaseous refrigerant in the evaporating compartment to the exterior of the evaporating compartment. The refrigerant discharging means has a U-bent tubular portion which is located in the evaporating compartment and a hole which is formed in the U-bent tubular portion so as to suck the lubricating oil stagnating in the evaporating compartment into the U-bent tubular portion.

In accordance with a fifth feature of the present invention, there is provided a falling film evaporator which includes refrigerant discharging means for discharging the gaseous refrigerant in the evaporating compartment to the exterior of the evaporating compartment, and lubricating-oil supplying means arranged to suck the lubricating oil in the evaporating compartment into the refrigerant discharging means.

In the above-described arrangement and construction, the gas-liquid separating means which is provided in the evaporating compartment of the falling film evaporator serves to introduce into the compressor the refrigerant gas which is produced by evaporating the liquid refrigerant in the evaporating compartment and simultaneously to suck the lubricating oil stored in the bottom portion of the falling film evaporator so that the lubricating oil may be supplied to the compressor, together with the aforesaid refrigerant gas. In consequence, a sufficient amount of lubricating oil is consistently reserved in an oil reservoir within the compressor, so that sliding portions for compressing the refrigerant can be satisfactorily lubricated and the reliability of the compressor can be maintained at a high level.

The above and other objects and features of the invention will become apparent from the following detailed description of embodiments thereof taken in connection with the accompanying drawings.

DETAILED DESCRIPTION OF THE PREFERRED EMBODIMENT

A preferred embodiment of the present invention will be described below with reference to the accompanying drawings.

Figure 1:
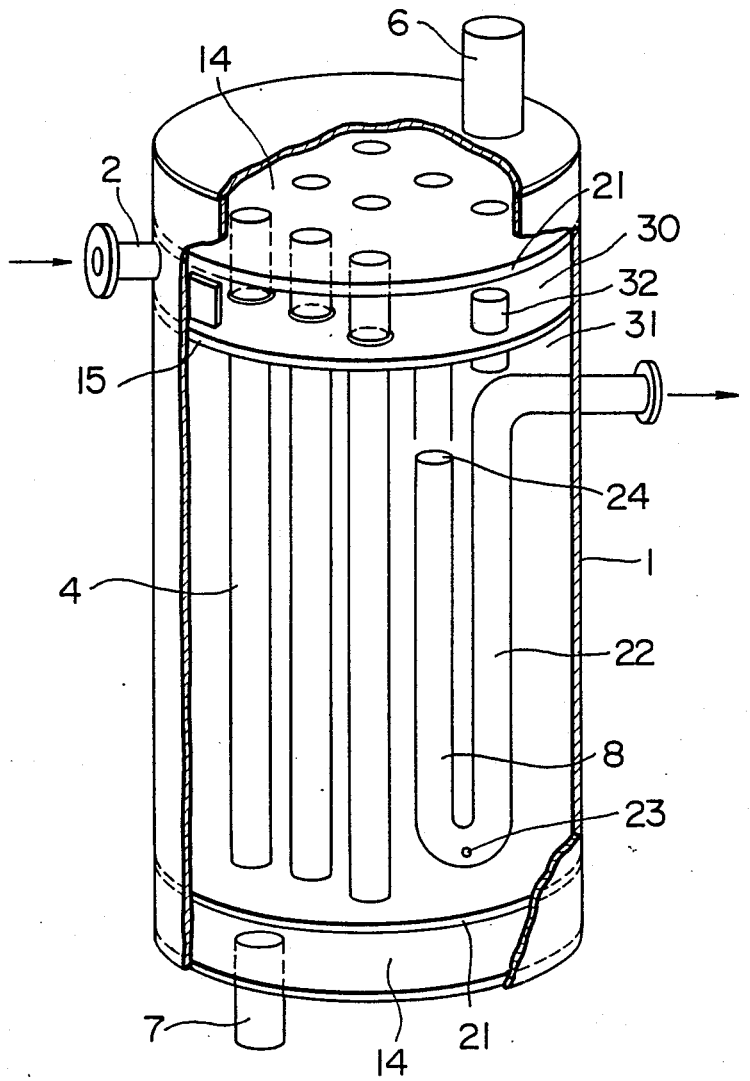
FIG. 1 is a diagrammatic perspective view showing in partial cross section an embodiment of the present invention.

FIG. 1 shows one embodiment of a falling film evaporator according to the present invention. As illustrated, liquid refrigerant flows into a refrigerant inlet 2 provided in a shell 1, passes through a refrigerant distributing compartment 30, and flows down over the outside surfaces of heat exchanger tubes 4. On the other hand, cooling water flows through a cooling water inlet 6 into a fluid compartment 14 provided in an upper portion of the shell 1. The cooling water which has flowed into the cooling water compartment 14 enters the interior of the heat exchanger tubes 4. Heat exchange is effected between the liquid refrigerant and the cooling water, and thus the cooling water is deprived of heat and is cooled. The cooling water which has been deprived of heat passes through a fluid compartment 14 provided in a lower portion of the shell 1. The upper fluid compartment 14 and a refrigerant-liquid distributing board 15 are partitioned from each other by a fluid-compartment partitioning board 21. A slight gap is formed between the refrigerant-liquid distributing board 15 and the outer peripheries of the respective heat exchanger tubes 4, and the liquid refrigerant flows down through the gaps. Gaseous refrigerant whose weight flow is less than that of the liquid refrigerant flows through the refrigerant inlet 2 into the refrigerant distributing compartment 30, and then enters an evaporating compartment 31 through a vapor vent tube 32 which places the refrigerant distributing compartment 30 in communication with the evaporating compartment 31 in which heat exchange is effected. The illustrated falling film evaporator which is constructed in the above-described manner employs, as its heat exchange medium, a refrigerant such as freon or ammonia which starts evaporating at a boiling point temperature lower than the temperature of the cooling water.

Figure 2:
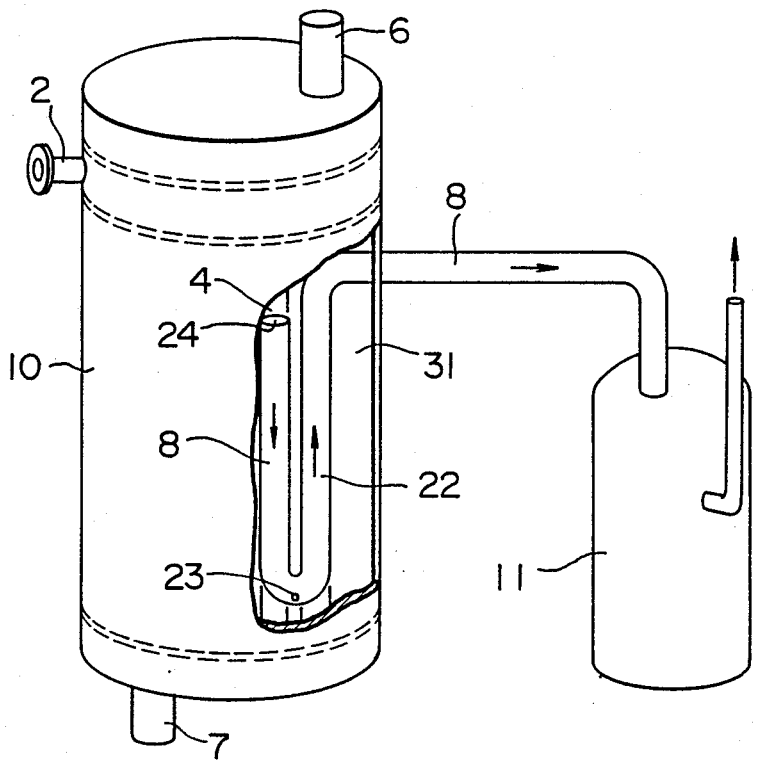
FIG. 2 is a diagrammatic perspective view showing in partial cross section an example in which the falling film evaporator, shown in FIG. 1, of the present invention is applied to a refrigeration cycle.

The refrigerant vapor which is generated by the evaporation of the liquid refrigerant and the vapor present within the refrigerant distributing compartment 30 pass through the vapor vent tube 32 and are mixed in the evaporating compartment 31. The resultant mixture, as shown in FIG. 2, enters a U-bent tube 22 through an inlet opening 24 and then flows toward a compressor 11. A hole 23 is formed in a lower portion of the U-bent tube 22. A portion of a lubricating oil which is used to lubricate sliding surfaces such as those of a piston for compressing the refrigerant within the compressor 11 is circulated together with the refrigerant in the refrigeration cycle without stagnating in the compressor 11. In the evaporating compartment 31, the lubricating oil flows down to the bottom of the evaporating compartment 31 without evaporating on the outer surfaces of the heat exchanger tubes 4, and is mixed with unevaporated liquid refrigerant at the bottom. The resultant mixture enters the interior of the U-bent tube 22 through the hole 23, passes through a refrigerant discharge tube 8 together with the gaseous refrigerant as a two-phase flow consisting of gas and liquid phases, and flows into the compressor 11.

The pressure in the portion of the hole 23 is negative with respect to the pressure in the evaporating compartment 31 by the amount of pressure loss which is produced when the refrigerant gas flows in the U-bent tube 22 from the inlet opening 24 to the hole 23.

If the aforesaid vapor vent tube 32 which places the refrigerant distributing compartment 30 in communication with the evaporating compartment 31 is provided in the refrigerant distributing board 15 above the U-bent tube 22, it is possible to effectively utilize the spaces above and below the refrigerant distributing board 15 which is located above the U-bent tube 22.

If the U-bent tube 22 is provided in the portion of the evaporator shell 1 which is shifted from the refrigerant inlet 2 by an angle of 180 degrees about the axis of the evaporator shell 1, the heat exchanger tubes 4 can be distributed uniformly with respect to the refrigerant inlet 2 without being obstructed by the U-bent tube 22. Accordingly, the liquid refrigerant can be made to uniformly flow down over the outer surfaces of the respective heat exchanger tubes 4.

There exists an optimum diameter of the hole 23 in the U-bent tube 22. The liquid refrigerant stagnates in the evaporating compartment 31 during system start-up or when the rate of circulation of the refrigerant within the compressor 11 is low. If the diameter of the hole 23 is excessively large, a large amount of liquid refrigerant flows through the hole 23 into the compressor 11, together with a lubricating oil to deteriorate the reliability of the compressor 11. More specifically, if the refrigerant returns to the compressor 11 in a liquid state, the compressing section in the compressor 11 which is designed to compress a gas must compress a liquid whose density is difficult to change. As a result, the compressor 11 is overloaded, and may be damaged. Since an excessive amount of refrigerant is present in a liquid state, particularly at the time of system start-up, when a compressor of a variable capacity type is operated in a low-capacity condition, or in a low-heat-load operation in which the rotational speed of a compressor is constant but in which the amount of heat generated by an object to be cooled is small, the above-described problem tends to occur.

On the other hand, if the diameter of the hole 23 is excessively small, the following problem may be encountered. If the amount of liquid refrigerant becomes excessive during system start-up or in a low-heat-load condition, the liquid level of the refrigerant in the evaporating compartment 31 becomes too high and the liquid refrigerant may return to the compressor 11 from the inlet 24 of the upper portion of the U-bent tube 22. On the other hand, even in a normal operation in which the amount of liquid refrigerant does not become excessive, when the oil level of the lubricating oil in the evaporating compartment 31 becomes high (that is, when the amount of lubricating oil stagnating in the compressor 11 becomes excessive), the amount of lubricating oil stagnating in the compressor 11 becomes small since the total amount of lubricating oil to be charged into the refrigeration cycle is constant. Futhermore, in this case, since the heat exchange surfaces of the heat exchanger tubes 4 which are brought into contact with the lubricating oil stagnating in the evaporating compartment 31 do not function as evaporating surfaces, the efficiency of the refrigeration cycle deteriorates. As described above, since the present invention adopts the structure in which the liquid refrigerant is stagnated in the evaporator, it is important to appropriately select the diameter of the hole 23. The hole 23 may be formed at any suitable position in the U-bent tube 22. The number of holes 23 is not limited to one and, for example, a plurality of holes 23 may be formed in the U-bent tube 23. The plurality of holes 23 may have diameters which differ from one another. The following description refers to a method of selecting an optimum diameter of the hole 23 when the hole 23 is located at a lower portion of the U-bent tube 22 and the number of holes 23 is one.

Figure 3:
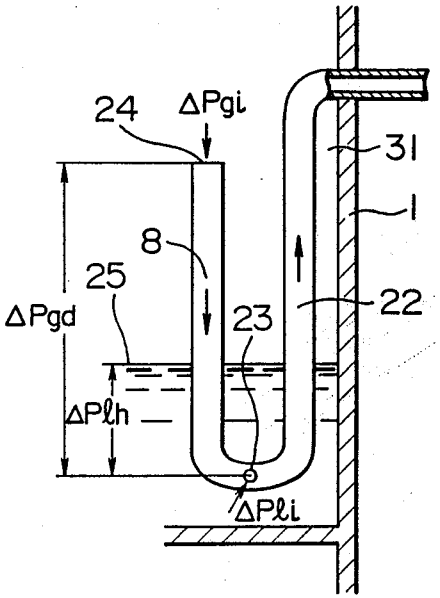
FIG. 3 is a view which serves to illustrate the principle of the operation of the present invention.

When the diameter of the hole 23 is appropriately selected, the height, denoted by 25, of the liquid level of the liquid refrigerant (which height includes the oil level of the lubricating oil contained in the liquid refrigerant) can be adjusted by utilizing the balance of pressure loss in each portion of the U-bent tube 22 according to the present invention, as shown in FIG. 3. Typically, the liquid refrigerant stagnates in the evaporating compartment 31 in a case where the compressor 11 is started as described above; where a low-capacity operation is performed in which the frequency of an inverter of the variable capacity type is low; and where a compressor of the fixed capacity type operates when its thermal load is low. In a normal operation, the oil level of the lubricating oil which lubricates the compressor 11 exists in the evaporating compartment 31. In FIG. 3, $\Delta P_{gi}$ is the inlet pressure loss when a refrigerant gas enters the U-bent tube 22, $\Delta P_{gd}$ is the pressure loss in the portion of the U-bent tube 22 from the inlet opening 24 to the hole 23, $\Delta P_{li}$ is the inlet pressure loss when the liquid refrigerant having the liquid level 25 enters the U-bent tube 22 through the hole 23, and $\Delta P_{lh}$ is the head of the liquid level of liquid refrigerant having a liquid-level height $h_l$ between the liquid level 25 and the position of the hole 23. $\Delta P_{lh}$ is proportional to the height $h_l$ of the liquid level of the liquid refrigerant, and $\Delta P_{li}$ is inversely proportional to the diameter of the hole 23. These pressure losses and the head are balanced as represented by the following equation $$\Delta P_{lh}+\Delta P_{li}=\Delta P_{gi}+\Delta P_{gd} \quad (1)$$

As described above, when the diameter of the hole 23 is changed, $\Delta P_{li}$ is changed and thus the height $h_l$ of the liquid level of the liquid refrigerant changes. Thus, it is possible to adjust the amount of lubricating oil stagnating in the evaporator 31. The height ho of an oil level from the hole 23 is determined by the following equation $$\Delta P_{oh}+\Delta P_{oi}=\Delta P_{gi}+\Delta P_{gd} \quad (2)$$

where $\Delta P_{oh}$ is the head of the oil level whose height is $h_o$, and $\Delta P_{oi}$ is the inlet pressure loss when the oil is passing through the hole 23. Further, since the head of the aforesaid refrigerant liquid is $\Delta P_{lh}=\rho_l g h_l$ and the head of the oil level of the lubricating oil is $\Delta P_{oh}=\rho_o g h_o$, the height $h_o$ of the oil level of the lubricating oil is determined. In this case, $\rho_l$ is the density of the liquid refrigerant and $\rho_o$ is the density of the lubricating oil. In the case of a refrigerant such as freon which is used in a normal refrigeration cycle, $\rho_o>\rho_l$ is obtained and $h_o<h_l$ is obtained even when $\Delta P_{oi}>\Delta P_{li}$. Therefore, the oil level of the lubricating oil is lower than the liquid level of the liquid refrigerant. In a certain kind of system, there is another case where the oil level of the lubricating oil becomes $h_o\sim 0$. Here, FIG. 3 shows a state of pressure balance, in which only the refrigerant liquid is existent above the hole 23, that is, the lubricating oil level $h_o$ is zero and the refrigerant liquid level is $h_l$. With the above-described method, it is possible to select the diameter of the hole 23 which can prevent an excessive amount of liquid refrigerant from stagnating in the evaporating compartment 31, which can prevent the oil level of the lubricating oil from becoming too high, and which enables an extra portion of the liquid refrigerant to be reserved.

Figure 4:
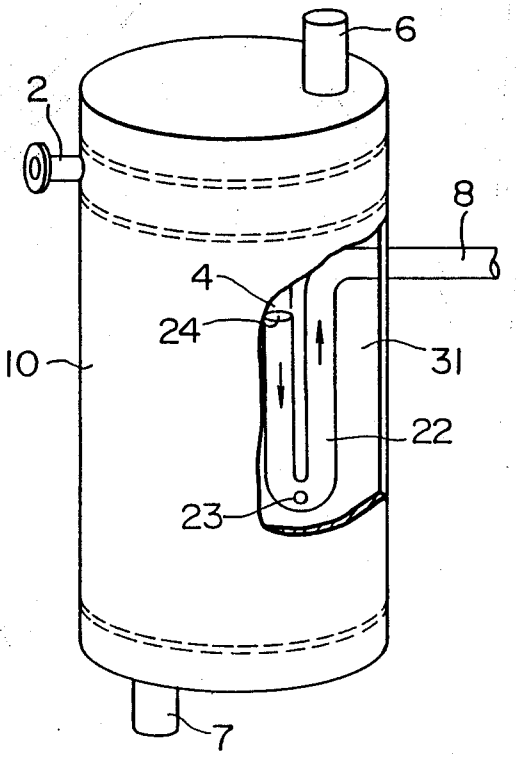
FIGS. 4 to 6 are partially cross-sectional views respectively showing partially modified forms of the falling film evaporation of the present invention shown in FIG. 1.

FIG. 4 is a partially modified form of the embodiment of the present invention. In this modified form, the position of the hole 23 formed in the U-bent tube 22 is selected to be sufficiently higher than the bottom of the evaporating compartment 31. In this case, the oil level of the lubricating oil becomes high, but since the heat exchange area required to implement evaporation of a thin film decreases, the liquid level of the portion of the liquid refrigerant which stagnates in the evaporating compartment 31 without evaporating in the thin-film evaporation process is increased. Accordingly, it is possible to effect transfer of heat from cooling water to liquid refrigerant in two forms of heat exchange: thin-film evaporation and boiling heat exchange employing fully charged liquid.

Figure 5:
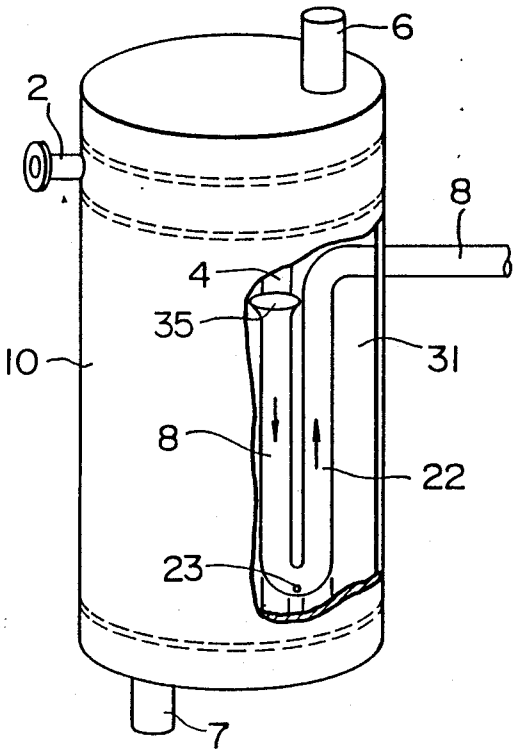

FIG. 5 shows another partially modified form of the embodiment of the present invention. In this modified form, the inlet opening of the U-bent tube 22 is formed into an opening 35 which is enlarged in a bellmouth-like configuration. In this configuration, since the aforesaid pressure loss $\Delta P_{gi}$ decreases, it is necessary to reduce $\Delta P_{li}$ in order to balance the decrement of $\Delta P_{li}$. Therefore, in order to keep the position of the liquid level equal to that of the liquid level which is realized when the opening 24 having no bellmouth-like configuration is employed, the diameter of the hole 23 needs to be enlarged. If the inlet opening of the U-bent tube 22 is formed into the bellmouth opening 35, the diameter of the hole 23 can be increased. Accordingly, it is possible to provide the effect of making it less likely that the hole 23 is clogged with foreign matter.

Figure 6:
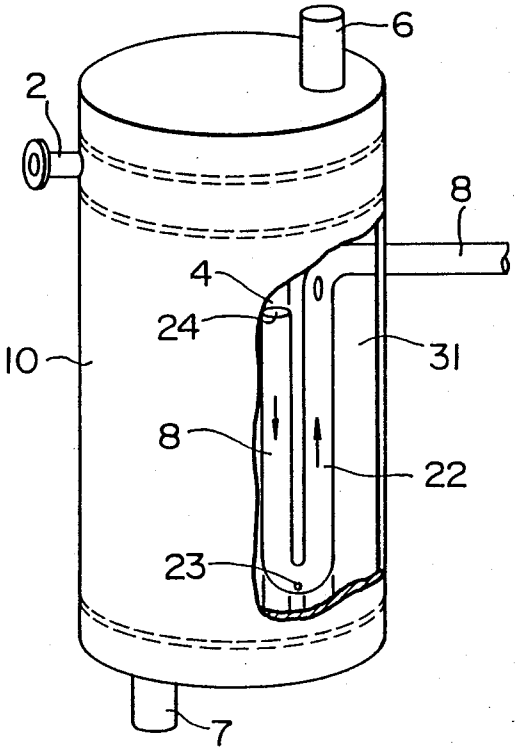

FIG. 6 shows another partially modified form of the embodiment of the present invention. In this modified form, two holes are formed in the U bent tube 22, and the diameter of a hole 36 is selected to be greater than that of the hole 23. In this case, the amount of refrigerant gas which is sucked through the opening 24 is less than the amount of refrigerant gas sucked through the hole 36, and the pressure losses $\Delta P_{gd}$ and $\Delta P_{gi}$ in the U-bent tube 22 decrease in a case where the diameter of the hole 36 is equal to or greater than that of the opening 24. Accordingly, it is possible to enlarge the diameter of the hole 23 as compared with the case where the hole 36 is not formed. In consequence, it is possible to make it less likely that the hole 23 is clogged with foreign matter.

Figure 7:
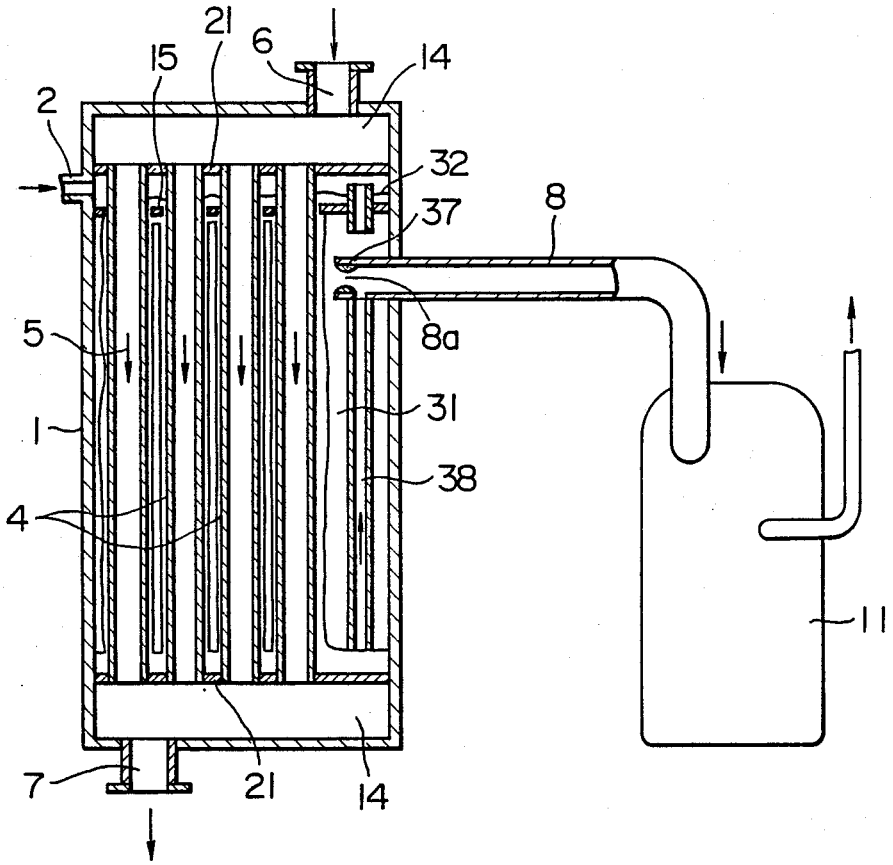
FIGS. 7, 8 and 10 are diagrammatic views respectively showing the refrigeration cycles of partially modified forms of the falling film evaporator shown in FIG. 1.

FIG. 7 shows yet another modified form of the embodiment of the present invention. In this modified form, a refrigerant gas is discharged through a refrigerant-gas discharge port 8*a* formed in an evaporator. Then the refrigerant gas intermingles with a highly densed lubricating oil which is mixed with liquid refrigerant and which is sucked through a lubricating-oil suction tube 38, and is introduced into the compressor 11. The presence of the refrigerant gas is reduced by the effect of a restriction 37 which is provided in a flow passage of the piping of FIG. 7. Accordingly, the pressure of the refrigerant gas becomes negative compared with the pressure in the evaporator in the intermingling section, and it is possible to suck the lubricating oil stagnating in the bottom of the evaporator through the lubricating-oil suction tube 38 through which is sucked the highly densed lubricating oil mixed with unevaporated liquid refrigerant. In this modified form, the evaporating section of a falling film evaporator can be used as a gas-liquid separator by introducing the highly densed lubricating oil, which is mixed with the liquid refrigerant stagnating in the bottom of the evaporator shell 1, into the refrigerant gas discharge tube 8 through the lubricating oil suction tube 58 and intermingling the lubricating oil with the refrigerant gas flowing in the tube 8. In this case, the size of the overall piping can be optimized according to the pressure loss due to the restriction 37 in the flow passage of the piping and the pressure loss in the lubricating oil suction tube 38.

Figure 8:
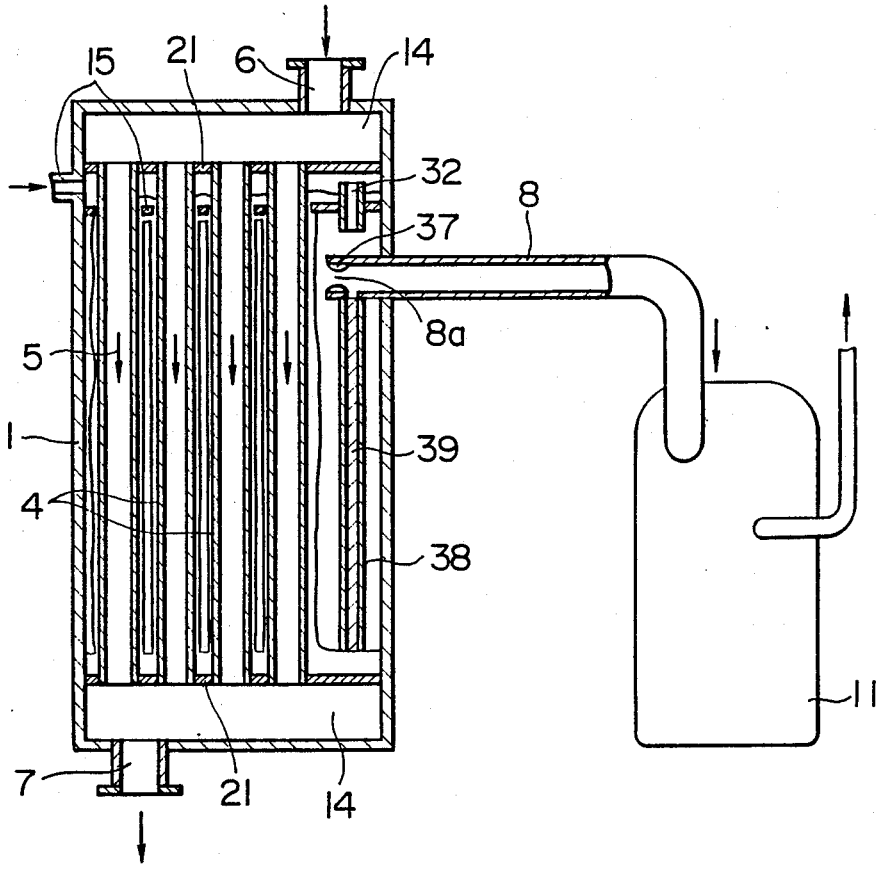

As shown in FIG. 8, if a helical groove 39 whose helix angle is 5 to 30 degrees with respect to the tube axis is formed at a fine pitch over the inner surface of the lubricating oil suction tube 38, a capillary phenomenon occurs so that the lubricating oil is easily sucked. Accordingly, it becomes possible to suck up the lubricating oil even if the pressure loss due to the restriction 37 in the flow passage is reduced. In consequence, it is possible to decrease the pressure loss in the piping between the evaporator and the compressor.

Figure 9:
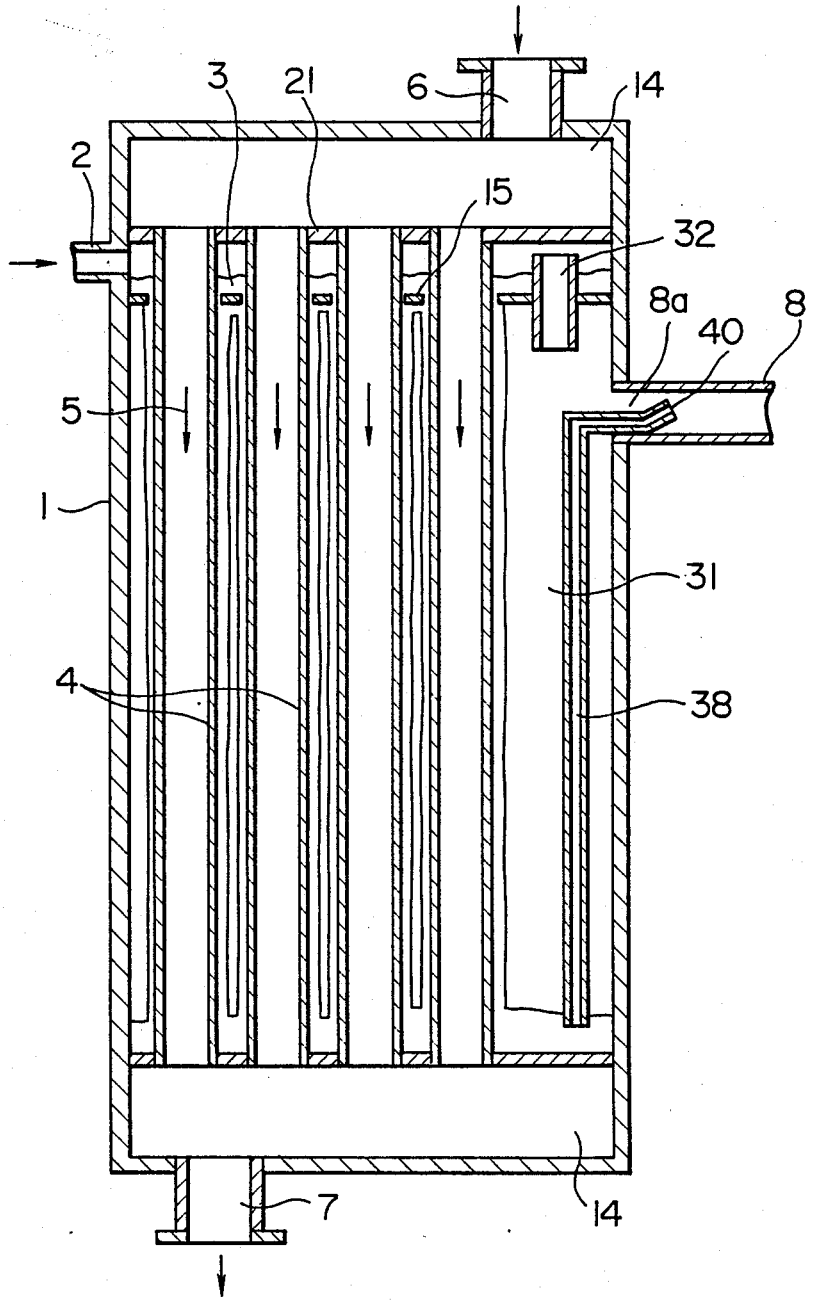
FIG. 9 is a vertical sectional view showing a partially modified form of the falling film evaporator shown in FIG. 1.

FIG. 9 shows another modified form of the embodiment of the present invention. In this modified form, the lubricating oil suction tube 38 is extended into the inlet portion of the refrigerant gas discharge tube 8 which extends from the evaporator shell 1 of the falling film evaporator. Since the flow of refrigerant gas is peeled off due to the effect of the edge of the refrigerant gas outlet 8*a* and thus the pressure in an opening 40 of the lubricating oil suction tube 38 becomes negative with respect to the pressure in the evaporator. It is therefore possible to inject, into the refrigerant gas, a highly densed lubricating oil which is mixed with the liquid refrigerant stagnating in the bottom of the evaporator shell 1.

Figure 10:
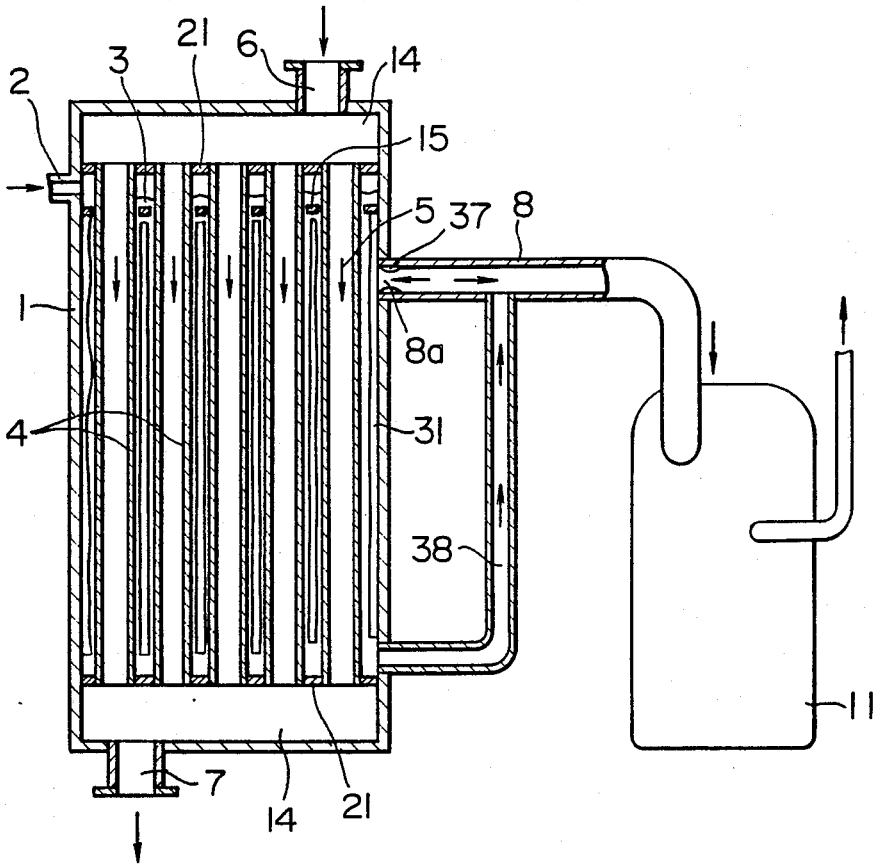

FIG. 10 shows still another modified form of the embodiment of the present invention. In this modified form, the refrigerant gas discharge tube 8 extends from the evaporator shell 1 of the falling film evaporator and the lubricating oil discharge tube 8 extends from the evaporator shell 1 separately from the refrigerant gas discharge tube 8 and is connected with the tube 8 in the exterior of the evaporator. In this case, the restriction 37 is incorporated in the refrigerant gas discharge tube 8 so that the pressure in the intermingling point of the refrigerant gas discharge tube 8 and the lubricating oil suction tube 38 may become negative with respect to the pressure in the evaporator. Thus, the highly densed lubricating oil mixed with the liquid refrigerant in the bottom of the evaporator shell 1 is sucked through the lubricating oil suction tube 38 and circulated to the compressor 11. In this case as well, the evaporator shell 1 can be used as a gas-liquid separator which serves as a liquid refrigerant reservoir during a transient process of a refrigeration cycle.

As described above, the refrigerant gas and the liquid refrigerant as well as the lubricating oil are respectively sucked into the compressor 11 through the refrigerant gas discharge tube 8 and the lubricating oil suction tube 38 which are provided in the interior or exterior of the evaporator. Accordingly, the following advantages can be obtained.

Since the gas-liquid separator which has conventionally been provided outside the evaporator is incorporated in the evaporator itself, neither the space for the gas-liquid separator nor the space associated therewith is required. Accordingly, the space are required for installation of equipment can be reduced and the total space can be saved. This arrangement is particularly effective when it is used in a cooling-water supplying device of the indoor type which must be installed in a limited area.

Another advantage is that since the evaporator functions as a gas-liquid separator, the pressure loss due to the flow of a refrigerant between the evaporator and the compressor is reduced, thus leading to an improvement in the efficiency of a refrigeration cycle.

Figure 11:
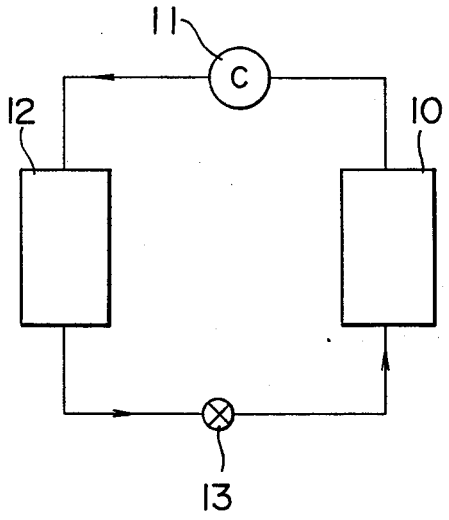
FIG. 11 is a system chart showing the refrigeration cycle to which the present invention is applied.

FIG. 11 is a system chart of the refrigeration cycle of the present invention. The refrigerant which is nearly gasified in a falling film evaporator 10 flows into the compressor 11, in which it is compressed into a high-temperature gas. The high-temperature refrigerant gas dissipates its retained heat in a condenser 12, passes through an expansion valve 13 in which a substantial portion of the refrigerant gas is converted into a liquid refrigerant, and is again supplied to the falling film evaporator, in which the liquid refrigerant effects heat exchange with cooling water. Arrows in FIG. 11 indicate the direction in which the refrigerant flows.

Figure 12:
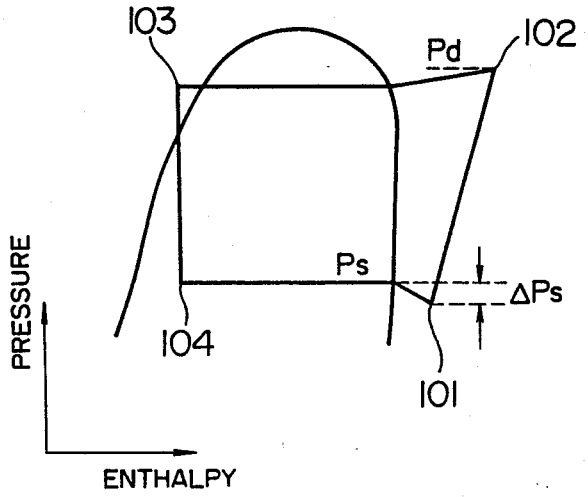
FIG. 12 is a chart showing the refrigeration cycle according to the present invention.

FIG. 12 is a so-called Mollier chart which shows a refrigeration cycle, in which enthalpy representing the energy of a refrigerant is plotted along the horizontal axis, while pressure is plotted along the vertical axis. In FIG. 12, the line between 101 and 102 represents the compression step of a compressor, the line between 102 and 103 represents the process between the compressor and a condenser outlet, the line between 103 and 104 represents the process between the condenser outlet and an expansion valve, and the line between 104 and 101 represents the process between the expansion valve and an evaporation outlet.

If $\Delta Ps$ is the pressure loss of the gas-liquid separator, the compression ratio of the compressor is as follows when the pressure loss $\Delta Ps$ occurs:

$$Pd/(Ps-\Delta Ps)$$

where Pd: discharge pressure of the compressor, and

Ps: suction pressure of the compressor (without the use of any external gas-liquid separator) Therefore, in the present invention, the above compression ratio increases as compared with the compression ratio Pd/Ps. As the above compression ratio increases, the efficiency of the compressor decreases and the load applied to the compressor increases, and therefore the power required increases. Since the gas-liquid separator is of the type incorporated in the evaporator as described above, the pressure loss between the evaporator and the compressor decreases and thus the efficiency of the refrigeration cycle improves.

In a conventional type of gas-liquid separator which is disposed in the exterior of an evaporator, a low-temperature liquid refrigerant stagnates in the interior of the gas-liquid separator. Accordingly, heat is transferred from the outside surface of the gas-liquid separator to the liquid refrigerant, and thus the liquid refrigerant evaporates, due to the external heat, within the gas-liquid separator, thus leading to thermal loss. In contrast, if a gas-liquid separator is of the type incorporated in an evaporator, as in the present invention, the cooling water passing through the heat exchanger tubes serves as a heat source which causes evaporation of the liquid refrigerant stagnating in the evaporator, and thus heat is transferred to the refrigerant tube from the cooling water to be cooled originally. In this fashion, the pressure loss in the gas-liquid separator is reduced to cool the cooling water even effectively, whereby the efficiency of the refrigeration cycle is improved.

In a falling film evaporator having the structure in which a lubricating oil is supplied to the refrigerant gas discharge tube through a lubricating oil suction tube and intermingled with the refrigerant gas in the refrigerant gas discharge tube, the suction force by which the lubricating oil stagnating in the bottom of the evaporator shell is sucked up into the refrigerant gas discharge tube is greatly influenced by the pressure loss which is determined by the length of the lubricating oil suction tube. Accordingly, if the aforesaid lubricating oil suction tube is provided in the evaporator shell which is relatively large compared with a small gas-liquid separator of the type which is externally installed, it becomes possible to increase the upper limit of the length of the lubricating oil suction tube and hence to select the oil level of a lubricating-oil sucking force with further widened freedom.

In accordance with the present invention, the falling film evaporator which is arranged to cause a refrigerant to flow down in a thin-film state to effect heat exchange at high heat conductivity is provided with the structure in which a U-bent tube or a lubricating oil suction tube is used to enable the evaporator to function as a refrigerant-liquid reservoir and in which, in a normal operation, an optimum amount of lubricating oil can be circulated to the compressor. Accordingly, since no externally-installed type of gas-liquid separator is required, the corresponding space can be saved. In addition, it is possible to decrease the pressure loss which cannot be avoided in the externally installed gas-liquid separator, and hence the heat loss due to the heat dissipation of the externally installed gas-liquid separator, whereby the efficiency of the refrigeration cycle can be enhanced.

What is claimed is:

1. In a falling film evaporator in which a plurality of heat exchanger tubes are provided in a shell to form an evaporating compartment utilizing a falling film, a liquid-film flow of a liquid refrigerant being formed over outside surfaces of said heat exchanger tubes to effect heat exchange between said liquid refrigerant and fluid flowing in said heat exchanger tubes, the improvement comprising a gas-liquid separating means which is arranged in a space of said evaporating compartment to communicate with a compressor which comprises a part of a refrigeration cycle; said gas-liquid separating means comprising a pipeline in which a lubricating oil in said evaporating compartment is intermingled with a refrigerant to be supplied from an evaporator to said compressor and through which the thus-intermingled fluid is supplied to said compressor and further comprising means for introducing a liquid refrigerant and a lubricating oil collected in a lower portion of the evaporating compartment into a refrigerant discharge pipeline by utilization of a pressure difference between a pressure in the evaporating compartment and a pressure in the refrigerant discharge pipeline, said pipeline serving to cause a gas refrigerant within the evaporating compartment to be discharged.

2. A falling film evaporator according to claim 1, wherein said pipeline through which the refrigerant in said evaporator is supplied to said compressor is disposed in the portion of said shell opposite to a liquid refrigerant inlet portion formed in said shell.

3. A falling film evaporator according to claim 1, wherein a refrigerant distributing compartment and said evaporating compartment are arranged in said shell, a vapor vent tube being arranged to place said refrigerant distributing compartment in communication with said evaporating compartment, and said pipeline through which the refrigerant in said evaporating compartment is supplied to said compressor being arranged at the position in said evaporating compartment which corresponds to said vapor vent tube.

4. A falling film evaporator according to claim 3, wherein said pipeline through which said refrigerant is supplied to said compressor has its one end connected to a suction side of said compressor and its other end opened within said evaporating compartment, and a U-shaped tubular portion which is located in said evaporating compartment, a hole through which the lubricating oil in said evaporating compartment is supplied to said pipeline being formed in a portion of said U-shaped tubular portion.

5. A falling film evaporator according to claim 3, wherein said pipeline is constituted by a first pipe having its one end connected to a suction side of said compressor and its other end opened within said evaporating compartment and a second pipe having its one end connected to said first pipe in said evaporating compartment and its other end portion introduced into the lubricating oil in said evaporating compartment.

6. A falling film evaporator according to claim 3, wherein said pipeline is constituted by a first pipe having its one end connected to the suction side of said compressor and its other end opened in said evaporating compartment and a second pipe having its one end connected to said first pipe outside said evaporating compartment and its other end introduced into the lubricating oil in said evaporating compartment.

7. In a falling film evaporator in which a plurality of heat exchanger tubes' are provided in a shell to form an evaporating compartment utilizing a falling film, a liquid-film flow of a liquid refrigerant being formed over the outside surfaces of said heat exchanger tubes to effect heat exchange between said liquid refrigerant and fluid flowing in said heat exchanger tubes, the improvement comprising a pipeline, through which refrigerant in said evaporating compartment is supplied to a compressor which comprises a part of a refrigeration cycle, being arranged in said evaporating compartment, said pipeline having a lubricating-oil supplying portion through which lubricating oil in said evaporating compartment is supplied to said pipeline.

8. In a falling film evaporator in which a plurality of heat exchanger tubes are provided in a shell to form an evaporating compartment utilizing a falling film, a liquid-film flow of a liquid refrigerant being formed over outside surfaces of said heat exchanger tubes to effect heat exchange between said liquid refrigerant and fluid flowing in said heat exchanger tubes, the improvement comprising a first pipeline which connects a liquid refrigerant inlet of said shell with a compressor side of a refrigeration cycle, a second pipeline which connects a refrigerant outlet of said evaporating compartment with said compressor which constitutes a part of said refrigeration cycle, and lubricating-oil supply means disposed in said second pipeline through which lubricating oil in said evaporating compartment is supplied to said second pipeline.

9. A falling film evaporator comprising:

an evaporator shell;

an upper fluid compartment which is arranged at an upper portion of said evaporator shell;

a lower fluid compartment which is arranged at a lower portion of said evaporator shell;

a refrigerant distributing compartment which is arranged below said upper fluid compartment;

an evaporating compartment arranged between said refrigerant distributing compartment and said lower fluid compartment;

a multiplicity of heat exchanger tubes, each of which extends through said refrigerant distributing compartment and said evaporating compartment, each of said exchanger tubes having its one end opened in said upper fluid compartment and its other end opened in said lower fluid compartment;

means for supplying cooling water to said upper fluid compartment;

means for discharging said cooling water from said lower fluid compartment;

means for supplying a refrigerant containing a lubricating oil to said refrigerant distributing compartment;

means for causing the liquid refrigerant in said refrigerant distributing compartment to flow downward over outside surfaces of said respective heat exchanger tubes; and refrigerant discharging means for discharging gaseous refrigerant in said evaporating compartment to the exterior of said evaporating compartment;

said refrigerant discharging means having a U-bent tubular portion which is located in said evaporating compartment and a hole which is formed in said U-bent tubular portion so as to suck lubricating oil stagnating in said evaporating compartment into said U-bent tubular portion.

10. A falling liquid evaporator comprising:

an evaporator shell;

an upper fluid compartment which is arranged at an upper portion of said evaporator shell;

a lower fluid compartment which is arranged at a lower portion of said evaporator shell;

a refrigerant distributing compartment which is arranged below said upper fluid compartment;

an evaporating compartment arranged between said refrigerant distributing compartment and said lower fluid compartment;

a multiplicity of heat exchanger tubes, each of which extends through said refrigerant distributing compartment and said evaporating compartment, each of said exchanger tubes having its one and opened in said upper fluid compartment and its other end opened in said lower fluid compartment;

means for supplying cooling water to said upper fluid compartment;

means for discharging said cooling water from said lower fluid compartment;

means for supplying a refrigerant containing a lubricating oil to said refrigerant distributing compartment;

means for causing the liquid refrigerant in said refrigerant distributing compartment to flow downward over outside surfaces of said respective heat exchanger tubes;

refrigerant discharging means for discharging gaseous refrigerant in said evaporating compartment from said evaporating compartment; and lubricating-oil supplying means arranged to suck lubricating oil in said evaporating compartment into said refrigerant discharging means.

11. In a refrigerator in which a compressor, a condenser, an expansion valve and a falling film evaporator are sequentially connected to constitute a refrigeration cycle, the improvement comprising gas-liquid separating means which is arranged in an evaporating compartment of said evaporator to communicate with said compressor and wherein said gas-liquid separating means has supply means through which a refrigerant is supplied from said evaporating compartment to said compressor and means for sucking lubricating oil in said evaporating compartment and intermingling said lubricating oil with the refrigerant passing through said supply means.

12. A refrigerator according to claim 11, wherein said supply means comprises piping through which a refrigerant is supplied from said evaporating compartment to said compressor.

13. A refrigerator according to claim 12, wherein a U-bent tubular portion is formed in the portion, which is located in said evaporating compartment, of said piping through which said refrigerant is supplied to said compressor, said U-bent tubular portion having a hole through which lubricating oil in said evaporating compartment is sucked into said piping.

* * * * *